US007496976B2

(12) United States Patent
Drechsel

(10) Patent No.: US 7,496,976 B2
(45) Date of Patent: Mar. 3, 2009

(54) LOCKING ROPE REEL

(76) Inventor: LaMont Drechsel, 66 E. 3335 South, Salt Lake City, UT (US) 84115

( * ) Notice: Subject to any disclaimer, the term of this patent is extended or adjusted under 35 U.S.C. 154(b) by 159 days.

(21) Appl. No.: 11/426,805

(22) Filed: Jun. 27, 2006

(65) Prior Publication Data

US 2007/0294817 A1 Dec. 27, 2007

(51) Int. Cl.
*E04H 4/502* (2006.01)

(52) U.S. Cl. ..... 4/502; 4/498

(58) Field of Classification Search ..... 4/498, 4/502

See application file for complete search history.

(56) References Cited

U.S. PATENT DOCUMENTS 3,050,743 A 8/1962 Lamb
3,979,782 A 9/1976 Lamb
4,060,860 A 12/1977 Lamb
4,466,144 A 8/1984 Lamb
4,858,253 A 8/1989 Lamb
5,105,481 A 4/1992 Lamb
5,524,302 A * 6/1996 Ragsdale et al. ..... 4/502
5,913,613 A 6/1999 Ragsdale et al.
5,920,922 A 7/1999 Ragsdale et al.
6,213,421 B1 * 4/2001 Franklin ..... 242/384.7

OTHER PUBLICATIONS

PCT/US07/14914, International Search Report, mailing date Apr. 16, 2008.
PCT/US07/14914, Written Opinion of the International Searching Authority, mailing date Apr. 16, 2008.

* cited by examiner

*Primary Examiner*—Huyen Le
(74) *Attorney, Agent, or Firm*—Holme Roberts & Owen, LLP

(57) ABSTRACT

A reel locking system includes a reel arranged to collect a cord from an enclosure system. A ratchet drum has teeth and is positioned proximate to the reel. A pawl assembly is pivotally attached to the reel. The pawl assembly has a pawl arranged to move between an engaged position in which the pawl drivingly engages a tooth of the ratchet drum and a ratchet position in which the pawl ratchets over the teeth. A lever is attached to the reel and is operable to lock the pawl in the engaged position and inhibit movement of the pawl to the ratchet position.

20 Claims, 3 Drawing Sheets

LOCKING ROPE REEL

BACKGROUND OF THE INVENTION

1. The Field of the Invention

The invention relates to systems for retractably positioning a cover over an opening of a space and, more particularly, the invention relates to a lock for rope reels of an automatic swimming pool cover system that has ropes attached to the cover which extend through tracks to the reels that are driven to wind the rope onto the reels and in turn to pull the cover over the swimming pool.

2. State of the Art

The use of automatic or motorized swimming pool covers on swimming pools is well known. Examples of such are described in U.S. Pat. No. 5,913,613 to Ragsdale et al. ("the '613 patent) and U.S. Pat. No. 5,920,922 to Ragsdale et al. ("the '922 patent").

Motorized or automatic pool cover systems of the type described in the '613 patent include some form of container at one of the pool to contain a retracted cover and to contain associated drive components. The container may be a recess or a well formed along a selected edge or a raised housing sometimes called a bench positioned at one end of the pool. Mounted in the well or housing is an elongated drum connected to a rotatable shaft which in turn is connected to an electric drive motor. One end of a flexible pool cover is secured to the drum. The drum is driven or rotated one way to collect the cover and open up the space (e.g., a swimming pool). The pool cover is extended over the top of the swimming pool by attaching draw cords or ropes to the opposite sides of the pool cover. The draw cords or ropes extend through groves formed in track that is fixed along two opposite sides of the space. One edge of the cover also slides in a groove of the track. The draw cords extend in the tracks down opposite sides of the pool and around a pulley rotatably fixed to the outermost end of their respective tracks. See U.S. Pat. No. 4,466,144 to Lamb and U.S. Pat. No. 3,979,782 to Lamb. Typically, the draw cord or rope is returned and secured to a collecting reel or rope reel which is rotatably carried on the same elongated shaft that attaches to and drives the cover-collecting drum.

Some systems have one rope reel for a rope at each side of the cover. One collecting reel may be carried on one side of the drum and the other may be carried on the other side. See U.S. Pat. No. 3,050,743 to Lamb and U.S. Pat. No. 4,060,860 to Lamb. It is presently preferable, however, to position both rope reels next to each other with pulleys positioned to direct the draw cords or rope to the appropriate reel. See U.S. Pat. No. 4,858,253 to Lamb. A coupling and double-dog clutch drivingly and alternately engage to drive the reels (to position the cover over the space) and to engage the drum (to wind the cover onto the drum and remove the cover from over the space) through the shaft. The double-dog clutch operates as illustrated and described in U.S. Pat. No. 5,105,481 to Lamb, the disclosure of which is hereby incorporated by reference.

The related art systems, although effective for the purposes designed, on occasion damage the pool cover fabric during the time it is being retracted on the collecting drum. Tearing or ripping of the cover fabric can occur when one side of the cover fabric is collected on the drum at a rate faster than the other side. Eventually, the cover fabric is damaged. Systems to avoid this problem and to avoid costly repairs of the pool cover fabric are not known.

BRIEF SUMMARY OF THE INVENTION

A reel locking system includes a reel arranged to collect a cord from an enclosure system. A ratchet drum has teeth and is positioned proximate to the reel. A pawl assembly is pivotally attached to the reel. The pawl assembly has a pawl arranged to move between an engaged position in which the pawl drivingly engages a tooth of the ratchet drum and a ratchet position in which the pawl ratchets over the teeth. A lever is attached to the reel and is operable to lock the pawl in the engaged position and inhibit movement of the pawl to the ratchet position.

In another aspect of the invention, a reel locking system includes a cord-collecting reel. A sleeve is positioned proximate to the cord-collecting reel. The sleeve has a plurality of teeth. A pawl is pivotally attached to the cord-collecting reel and operable to engage a tooth of the plurality of teeth. A lever is attached to the cord-collecting reel. The lever is capable of pivoting between a locked and unlocked position. The lever includes a contact end shaped to contact the pawl and lock the pawl by engaging a tooth of the sleeve.

In a further aspect of the invention, a method of locking and unlocking a reel in a cover system is disclosed. A cover system includes a cord attached to one edge of a cover, a reel for drivingly collecting the cord, a sleeve having teeth that is positioned proximate to the reel, a pawl assembly having a pawl that engages a tooth of the teeth that is attached to the reel, and a lock for locking the pawl in an engaged position. The reel rotates relative to the sleeve until the pawl moves to the engaged position by engaging a tooth of the teeth. The lock operates to a locked position to hold the pawl in the engaged position.

In a further aspect of the invention, method of making a reel locking system for use in an automatic cover system is disclosed. In the method, a pawl is attached to a reel to pivotally rotate it about a point. A spring is attached to the pawl to exert a force towards the center point of the reel. A lever is attached to the reel to pivotally rotate it about another point where the pawl contacts the lever in a locked position and clears the lever in an unlocked position.

These and other features of the present invention will become more fully apparent from the following description, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE EXEMPLARY EMBODIMENTS

Reference will now be made in detail to the exemplary embodiments of the present invention, examples of which are illustrated in the accompanying drawings. The various exemplary embodiments provide systems for retractably positioning a cover over an opening of a space. The exemplary embodiments are not intended to limit the scope of the invention as defined in the appended claims.

Figure 1:
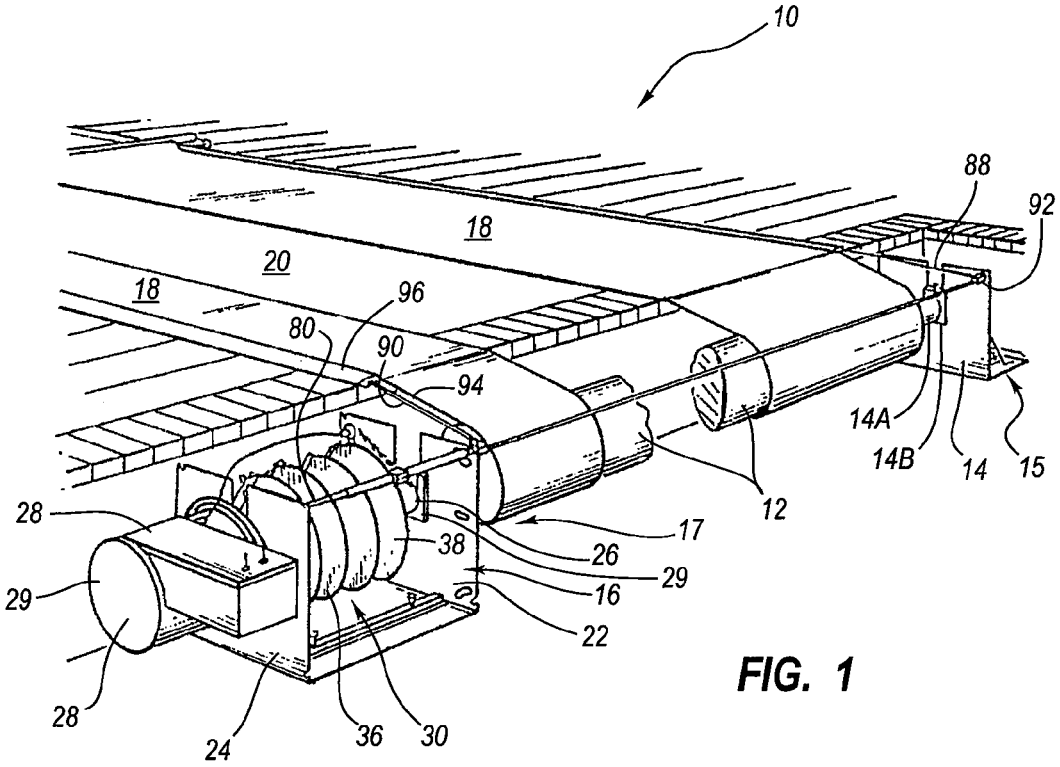
FIG. 1 is a perspective view of an enclosure system of the present invention.
Figure 2:
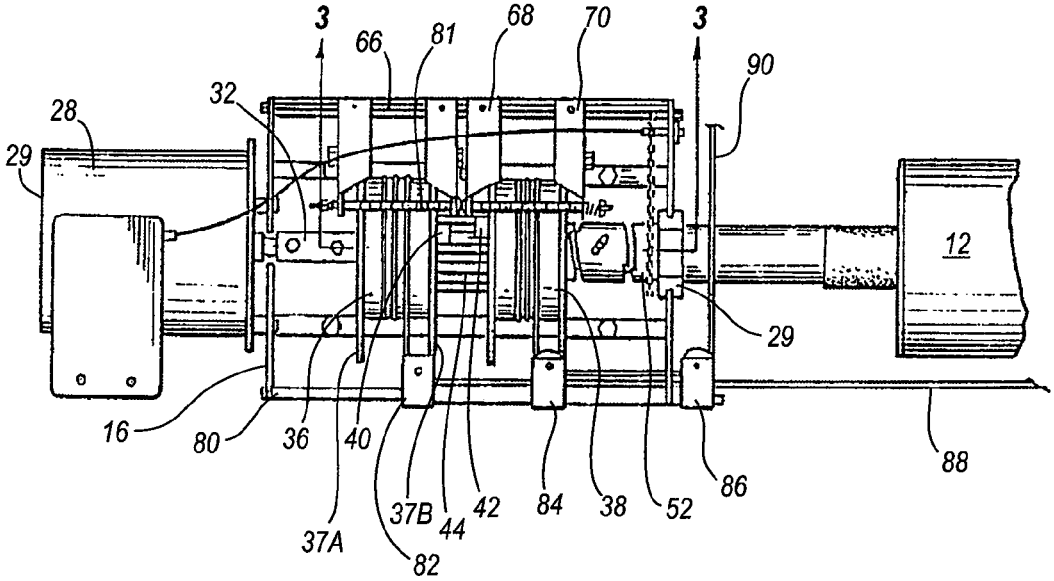
FIG. 2 is a detailed side view of the enclosure system illustrated in FIG. 1.

FIGS. 1 and 2 illustrate an exemplary enclosure system 10 which includes a drum 12 that is supported by a support member 14 on the free end 15 and a drive mechanism support member 16 on the driven end 17. The drum 12 has a shaft extension 14A sized and arranged to rotate in pillow block bearing 14B which is supported by the support member 14. At the driven end 17, drive mechanism support member 16 also supports a pillow bearing 29 sized to receive and rotatably support shaft 26. The shaft 26 is driven by a drive means such as a motor 29 to in turn rotate the drum 12 and thereby collect a cover 18 on or around the drum 12. That is, the drum 12 retracts and collects the cover 18 from an opening 20 such as a swimming pool. To extend the cover 18 over the opening 20, the drum 12 freewheels as the cover 18 is pulled off by draw cords, cables or ropes 88 and 90 as described hereinafter in more detail.

The drive mechanism support member 16 includes two vertical side plates 22, 24. The first vertical side plate 22 is arranged to support the shaft 26 on bearing 29 extending out from the drum 12. The second vertical side plate 24 is arranged to support a drive mechanism 28, such as an electric motor 29. The drive mechanism may also be a hydraulic motor or other power means suitable to provide rotational torque sufficient to rotate the drum 12 to retract the cover 18 from the opening 20 and to rotate the reel mechanism 30 to pull the cover 18 over the opening 20. A hand crank mechanism can also be used with suitable gearing connected to the shaft 26 when the gearing has adequate mechanical advantage.

Figure 3:
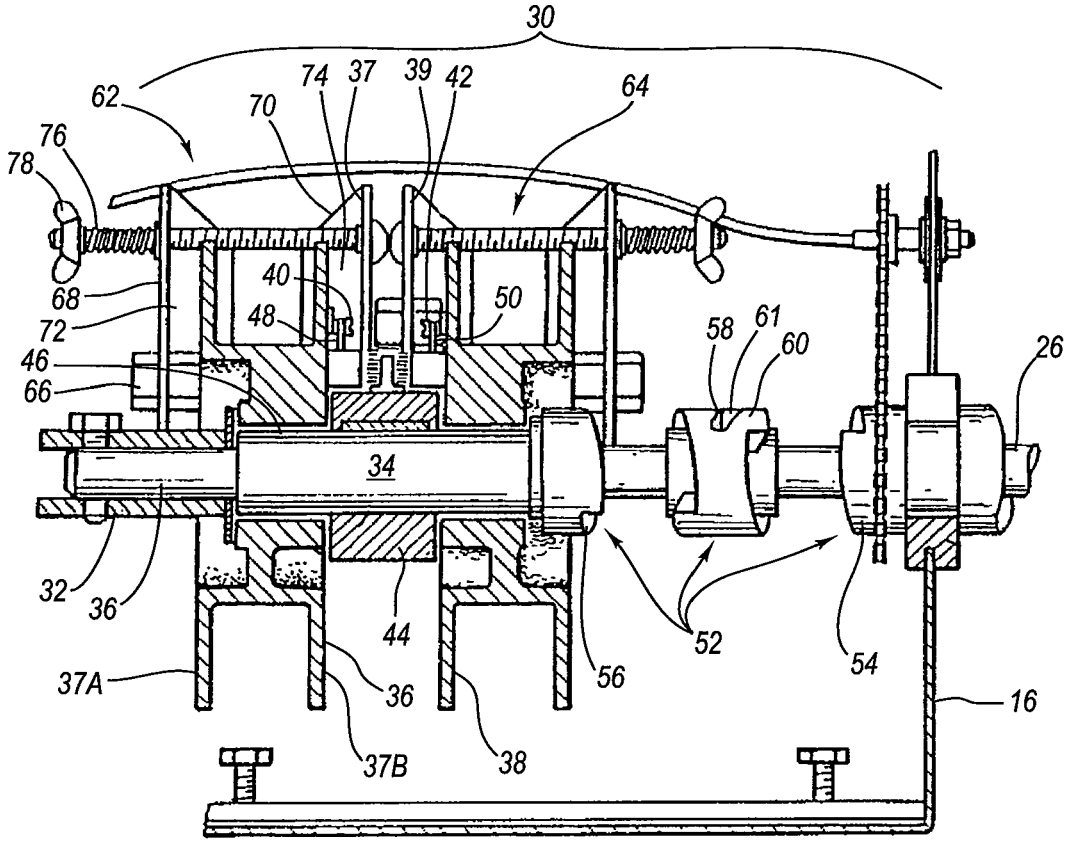
FIG. 3 is a detailed cross-section of the enclosure system illustrated in FIG. 2.

In FIG. 3, the drive motor 29 is coupled by a motor coupling 32 to the shaft assembly 26. The cord-collecting reel assembly 30 is positioned on the shaft assembly 26 between the motor 29 and the drum 12.

A hollow sleeve 34 circumscribes the shaft assembly 26 adjacent to the motor coupling 32. A first cord-collecting reel 36 and a second cord-collecting reel 38 freely rotate about the sleeve 34. The sleeve 34 also freely rotates about the shaft assembly 26. Pawls 40 and 42 are spring loaded, and are fixed to the inner walls 37 and 39 of reel means such as the cord-collecting reels 36 and 38, respectively. A ratchet drum 44 is secured to the hollow shaft 34 by means of a slot 46 and key 47. The pawls 40 and 42 have teeth-like teeth or tips 41 sized to engage the cogs 43 of the ratchet drum 44. Springs 48 and 50 are arranged to torque the teeth such as tooth 41 of the pawls 40 and 42 into the spaces 45 between cogs 43. The cogs 43 of the ratchet drum 44 are spaced at even radial increments for engaging the pawls 40, 42 with the ratchet drum 44. Counter-clockwise rotation of the ratchet drum 44 causes both of the cord-collecting reels 36, 38 to likewise turn in unison in a counter-clockwise direction due to the engagement of the tips or teeth 41 of the pawls 40, 42 in the cogs 43 of the ratchet drum 44. When the cover 18 is being closed, it may wind up unevenly on the drum 12. In turn, one of the cords 88 or 90 may become excessively taut because one side of the cover 18 is on the drum with the other side still partially out or not on the drum 12. The pawl 40 and 42 on the taut reel will slip causing the rotational rate of one reel 36 to vary with respect to the rotation rate of the other (that is taut). Thus the side of the cover that is not wound on to the drum may continue onto the drum. In installation, the rate of rotation can be adjusted using the brake components 62 and 64 (FIG. 3). Thus the tensions on both cords can be adjusted to ensure that the cover 18 will wind up squarely on the drum 12.

The drive mechanism that is connected to one end of the shaft assembly 26 is, for example, a reversible electric motor of about one-quarter to one-half horsepower and a gear-speed reducer capable of producing from about 18 to about 60 revolutions per minute. Power is transmitted from the drive mechanism 28 to either the cord-collecting reels 36, 38 or the drum 12 by a clutch system 52, such as a spiral-jaw clutch or a double dog clutch system. This clutch system 52 comprises three major elements as shown in FIGS. 2 and 3: a first end member 54 fixed to the shaft assembly 26 on the side where the drum is driven, a second end member 56 fixed to the hollow shaft 34 on the side where the cord-collecting reel is driven, and a double driver member 58 having a shifting collar 60 with a diagonal cam slot 61. The double driver member 58 is fixed to the shaft assembly 26 by a fastener such as a shear pin, key, screw, bolt, pin, or other means known to one skilled in the art to fix a mechanism to a shaft. By fixing the double driver member 58 to the shaft assembly 26, the shifting collar 60 can be moved laterally along the shaft assembly 26. When viewing shaft assembly 26 from right to left facing the opening or pool, clockwise rotation of the shaft assembly 26 causes the shifting collar 60 to slide to the right and engage the first end member 54 and thereby cause clockwise rotation of the drum. During clockwise rotation, the cover 18 is retracted and collected on the drum.

When the shaft assembly 26 is rotated in a counter-clockwise direction, the shifting collar 60 moves laterally to the left and engages the second end member 56, causing the reels 36 and 38 to rotate in a counter-clockwise direction. During rotation of the cord collecting reels 36 and 28, the cords 88 and 90 extending out from the beads of the pool cover 18 are collected on the reels 36 and 38 pulling the cover 18 over the space such as a swimming pool.

During extension and retraction of the swimming pool cover 18, it is desirable to maintain a pre-selected tension on the pool cover 18 through the draw cords or ropes 88 and 90 by applying an adjustable drag or braking force to each of the cord-collecting reels. This is accomplished by the brake components 62 and 64 as illustrated in FIG. 3. Since the brake components 62 and 64 are substantially identical, only brake component 62 will be described in detail.

The brake component 62 includes a shaft 66 that is loosely connected to the drive mechanism support member 16 to pivot a pair of elongated arms 68, 70 having brake shoes 72, 74 fixed to each of the inner walls of the elongated arms 68, 70. These brake shoes 72, 74 are positioned to face the outer walls 37A and 37B of the first cord-collecting reel 36 and rotate about the brake bar 81. A spring-loaded, threaded bolt 76 passes through the top portion of the elongated arms 68, 70. The end of the threaded bolt 76 is adapted to receive a nut such as a wing nut 78. Turning the wing nut 78 clockwise urges the arms 68, 70 and brake shoes 72, 74 against the outer walls of the first cord-collecting reel 36. This type of brake system is reported in U.S. Pat. No. 4,060,860 the disclosure of which is hereby incorporated herein by reference.

A rod 80 is attached to the drive mechanism support member 16 on a side opposite the brake system as shown in FIG. 2. The rod 80 is arranged to accommodate three pulley assemblies 82, 84, 86 for directing draw cords 88, 90 to and from the cover 18. The pulley assemblies 82, 84, 86 are spaced from each other to align the draw cords 88, 90 from the cover 18 to the cord-collecting reels 36, 38. The first pulley assembly 82 is aligned with the first cord-collecting reel 36 to align the draw cord 90 from the far end of the cover 18. The second pulley assembly 84 is aligned with the second cord-collecting reel 38 to align the draw cord 88 from the near end of the cover 18. The third pulley assembly 86 is aligned outside of the drive mechanism support member 16 to redirect the draw cord 88 from the cover 18 to the second pulley assembly 84. A fourth pulley assembly 92, shown in FIG. 1 is positioned on the support member 14. The fourth pulley assembly 92 redirects the draw cord 90 from the cover 18 to the first pulley assembly 82. The ends of each of the draw cords 88, 90 are attached to the outer ends of the cover 18 to pull the cover 18 across the opening 20. The other ends of each of the draw cords 88, 90 are attached to the cord-collecting reels by any suitable means. A pair of return pulleys (not shown) is positioned on the outer end of the opening to permit the cover 18 to be fully extended during the covering process.

As shown in FIG. 1, the cover 16 has beaded side edges 94 attached to the side of the cover 18 that slide and are contained in channels 96. The channels 96 are fixed to the longitudinal side margins of the opening 20. The channels 96 have a groove on an inner side facing the opening 20 that is shaped to accommodate the beaded side edges 94 and the cords 88 and 90 so the cover can pulled outward over the space 18. The channels also have a groove to accommodate the draw cords 88, 90 returning toward the drum 12 and in turn the reels 36 and 38. That is, return pulleys are placed at the outer ends of the channels 96 and arranged so that the draw cords 88, 90 are guided out through the outer groove, around the return pulley, and in through the inner groove while opening the cover 16. While closing the cover, the draw cords 88, 90 are pulled from the ends of the cover 16 through the inner groove, around the return pulley, and in through the outer groove to the cord-collecting reels 36, 38.

Figure 4:
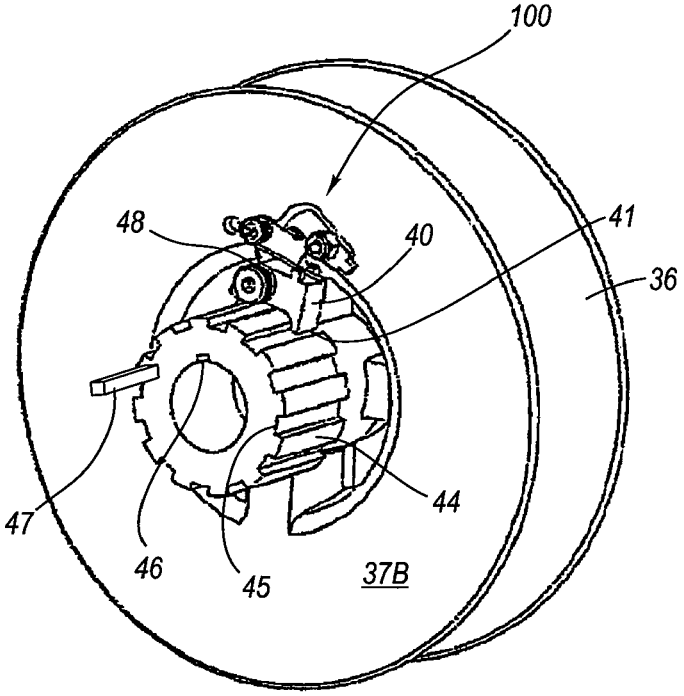
FIG. 4 is a perspective view of a partial assembly of a reel locking system.
Figure 5:
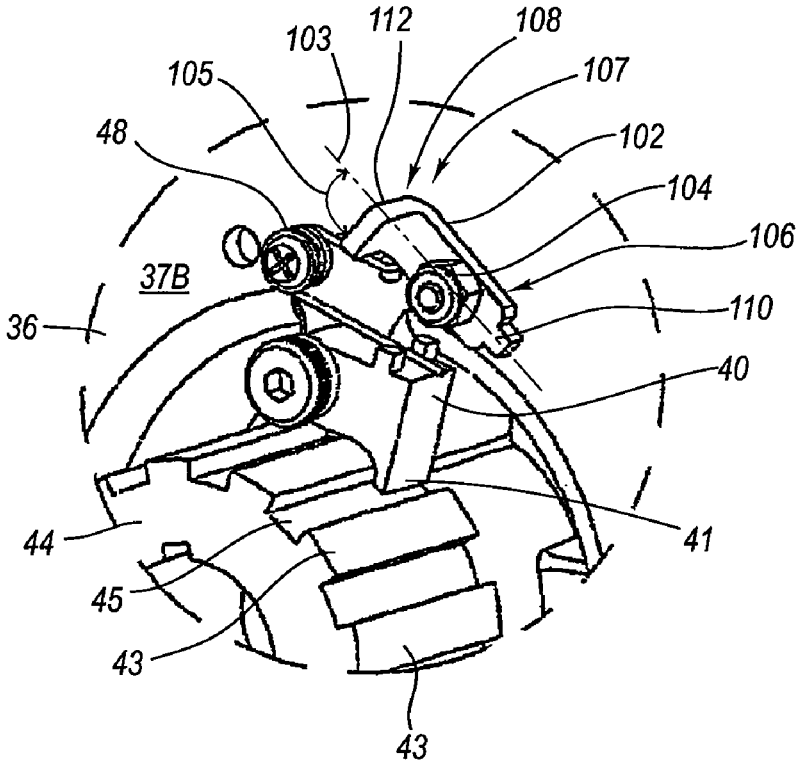
FIG. 5 is a detailed view of the partial assembly shown in FIG. 4 illustrating an unlocked position.
Figure 6:
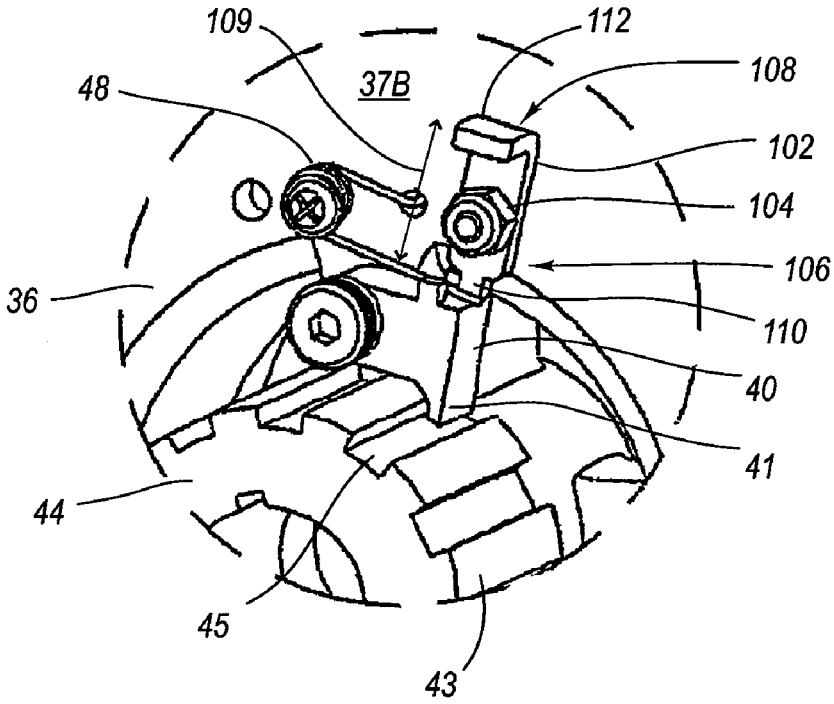
FIG. 6 is a detailed view of the partial assembly shown in FIG. 4 illustrating a locked position.

A reel locking system 100 is shown in FIGS. 4-6. Since each reel locking system is substantially the same for each cord-collecting reel 36, 38, only one system will be discussed in detail. The reel locking system 100 includes a lever 102 that is pivotally attached to the cord-collecting reel 36 by inserting a fastener 104, such as a bolt and locking nut, cotter pin, rivet, or other known means for pivotally attaching a device to a surface. Flat or lock washers may also be used. The fastener 104 is inserted into a hole (not shown) that is drilled, bored, or otherwise machined through the surface of a wall 37B of the cord-collecting reel 36. The lever 102 is here shown to be rectangular in cross section, but it may be any cross section desired as long as it has sufficient structural strength to hold the pawl 40 in place. The lever 102 has a length extending along its axis 103

The lever 102 includes a contact end 106 shaped to fit against a surface of the pawl 40 and a grip end 108 to assist a user to rotate the lever 102 to a desired position. The contact end 106 can be shaped in various arrangements, for example, it can be tapered, pointed, flat, round, jagged, or any other shape that allows the contact end 106 to fit against a surface of the pawl 40. In the exemplary embodiment, the contact end is cut, punched, formed, or otherwise machined to have a tip 110 at the outermost end. The tip 110 can be rectangular in projection and even rectangular in cross section transverse to axis 103. The contact end 106 is shaped to provide a surface 106A large enough to fit against the pawl 40 and small enough to rotate the corners around to position the contact end 106 in-line with the pawl 40.

The reel locking system 100 can be rotated between an unlocked position as shown in FIG. 5 and a locked position as shown in FIG. 6. In the locked position, the lever 102 is positioned with the contact end 106 against or just above a surface of the pawl 40. When the lever 102 is in the locked position, the locking system 100 restricts the pawl 40 from moving upward away from the ratchet drum 44 to prevent the pawl 40 from disengaging the teeth of the ratchet drum 44. By restricting the movement of the pawl 40, the cord-collecting reel 36 is restricted from rotating with respect to the ratchet drum 44. If the fastener 104 is a bolt and nut, the nut is loosened enough to rotate the lever 102 in the locked position, then tightened to hold the lever 102 in place. In the unlocked position, the lever 102 is rotated to a location where the lever 102 does not restrict the movement of the pawl 40 with respect to the ratchet drum 44.

The grip end 108 is located on the lever 102 opposite the contact end 106. The grip end 108 can include a handle 112 to assist in gripping the lever 102. The handle 112 can be a piece welded, molded, or fastened to, or formed from, the lever 102 that extends out from the lever 102. For example, the handle 112 can be formed by bending the grip end 108 out at an angle from the axis 103 of the lever 102. When bending the lever to form the handle 112, the angle can be set, for example, between about 10 degrees to about 170 degrees relative to the axis 103. The exemplary embodiment shows the angle 105 of the handle to be about 90 degrees to the lever 102.

The lever 102 may be made from a metal, plastic, or other rigid material. The exemplary embodiment has a lever 102 made of a stainless steel material to provide corrosion resistance. The lever 102 is sized in width 107 to accommodate the hole for fastener 104. In the example, the lever 102 is about 0.25 inches thick, about 0.375 inches wide 107, and about 1.0 inch long 109. The handle 112 extends up from the lever 102 about 0.375 inches. The tip 110 is about 0.25 inches wide by about 0.25 inches long. The distance from the fastener 104 to the end of the tip 110 is about 0.5 inches.

The reel locking system 100 gives the user an option of allowing one or both the cord-collecting reels or rope reels 36 and 38 to rotate with respect to each other while in the unlocked position. The cord tension 88 in one cord-collecting reel 36 may become greater than the other. When one cord 88 or 90 becomes taut, the corresponding pawl slips with respect to the ratchet drum 44 to allow the tension in the cords to even out. Use of the brakes 62 and 64 may also be used to regulate the reels 36 and 38 so that the cover 18 pulls out evenly to close the pool and returns evenly to open the pool (or space being covered). Once the enclosure system 10 has been adjusted, the reel locking system 100 can be operated to lock one or both reels 36 and 38 and preferably both reels 36 and 38 so that the cover 18 upon retraction to the open position will necessarily always wind up evenly and will always move toward the closed position evenly. That is, variable tension on one cord, e.g., cord 88 and not the other, e.g., cord 90, may be experienced for a variety of reasons. The varying tension can cause the cover 18 to wind on the drum 12 crooked or to move toward the closed position with the leading edge of the cover 18 at an angle with respect to the end of the pool thereby leaving a portion of the pool uncovered. In turn, the cover 18 may not be fully retracted on one end or extended on the other. Unbalanced operation may also lead or cause other increased rope wear, damage to the cover itself and damage to the drive mechanism. By locking both rope reels 36 and 38 after initially balancing the tension and extendable length of the ropes 88 and 90, the cords or ropes 88 and 90 are supplied at about the same rate for balanced operations. It is preferred to have both reels 36 and 38 locked using a locking system like system 100.

It may also be noted that the locking system 100 allows technicians to return and easily rebalance the length and tension of the ropes 88 and 90 from time to time. The ropes 88 and 90 may stretch, wear, or otherwise deteriorate unevenly so that periodic rebalancing may be required. The reels can be unlocked to facilitate rebalancing by operating the lever 102 for each reel 36 and 38. Thereafter, balancing of the ropes 88 and 90 is effected as discussed herein before.

While the enclosure system 10 and the reel locking system 100 has been described with reference to the specific embodiment described, the descriptions are only illustrative and are not to be construed as limiting the invention. As such, the optimal dimensional relationships for the parts of the exemplary embodiment of the invention can be varied in size, materials, shape, configurations, form, function and manner of operation. The optimal dimensional relationships, use and assembly that are readily apparent to those skilled in the art and all equivalent relationships to the embodiments illustrated in the drawings and described in the specification are intended to be encompassed by the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A reel locking system, comprising:

a reel arranged to collect a cord from an enclosure system;

a ratchet drum having teeth, said ratchet drum being positioned proximate to said reel;

a pawl assembly pivotally attached to said reel, said pawl assembly having a pawl arranged to move between an engaged position in which said pawl drivingly engages a tooth of said ratchet drum at a first contact point of said pawl and a ratchet position in which said pawl ratchets over said teeth, wherein said pawl further includes an extension extending from a surface away from said first contact point; and a lever attached to said reel, said lever being rotatable to lock said pawl in said engaged position and inhibit movement of said pawl to said ratchet position by engaging with at least said surface to inhibit rotational movement of said pawl away from said ratchet drum, and wherein said extension being used for inhibiting rotational movement of said lever when in said engaged position.

2. The system of claim 1, wherein said lever has a grip end positioned opposite a contact end, said contact end being configured for contact with said pawl.

3. The system of claim 2, wherein said grip end further includes a handle.

4. The system of claim 3, wherein said lever has an axis and wherein said handle is unitarily formed with said lever and positioned at an angle away from said axis.

5. The system of claim 4, wherein said angle is at about 90 degrees from said lever.

6. The system of claim 1, wherein said contact end further includes a tip at its outermost end.

7. The system of claim 6, wherein said tip is rectangular in projection.

8. The system of claim 1, wherein said lever is rotatable between an unlocked position and a locked position.

9. A reel locking system, comprising:

a cord-collecting reel;

a sleeve positioned proximate to said cord-collecting reel, said sleeve having a plurality of teeth;

a pawl pivotally attached to said cord-collecting reel and operable to engage at a first contact point of said pawl a tooth of said plurality of teeth, wherein said pawl further includes an extension extending from a surface away from said first contact point; and a lever attached to said cord-collecting reel, said lever being pivotable between a locked and unlocked position, said lever including a contact end shaped to contact said pawl and lock said pawl by engaging a tooth of said sleeve, wherein said lever being pivotable to said locked position allowing the engagement of said contact end with said surface to inhibit rotational movement of said pawl away from said cord-collecting reel, and wherein said extension being used for inhibiting rotational movement of said lever when in said locked position.

10. The system of claim 9, wherein said lever further includes a grip end positioned opposite said contact end and being shaped to allow a user to grasp said lever.

11. The system of claim 10, wherein said grip end further includes a handle attached to said lever, which is shaped to allow a user to grasp said lever.

12. The system of claim 11, wherein said lever has an axis and wherein said handle is a section of said lever that is formed to extend away from said axis of said lever.

13. The system of claim 9, wherein said contact end further includes a tip formed on the outermost end of said contact end.

14. The system of claim 13, wherein said tip is rectangular in cross-section.

15. A method of locking and unlocking a reel in a cover system, said method comprising:

providing a cover system including:

a cord attached to one edge of a cover, a reel for drivingly collecting said cord, a sleeve positioned proximate to said reel, said sleeve having teeth, a pawl assembly attached to said reel, said pawl assembly having a pawl that engages a tooth of said teeth at a first contact point of said pawl, wherein said pawl further includes an extension extending from a surface away from said first contact point, and a lock for locking said pawl in an engaged position;

rotating said reel relative to said sleeve until said pawl moves to said engaged position by engaging a tooth of said teeth; and rotating said lock to a locked position to hold said pawl in said engaged position, wherein said lock is rotated to engage with said surface to inhibit rotational movement of said pawl away from said ratchet drum, and to engage with said extension to inhibit rotational movement of said lock when in said engaged position.

16. The method of claim 15, wherein said lock is rotatable to an unlocked position by placing said lever in a location where said lever does not restrict the movement of said pawl with respect to said sleeve.

17. A method of making a reel locking system for use in an automatic cover system, said method comprising:

attaching a pawl to a reel to pivotally rotate about a point, wherein said pawl includes an extension extending from a surface;

attaching a spring to said pawl to exert a force towards the center point of said reel;

attaching a lever to said reel to pivotally rotate about another point where said pawl contacts said lever in a locked position and clears said lever in an unlocked position;

pivoting said lever to said locked position for engaging said lever with said surface to inhibit rotational movement of said pawl around said point and for engaging said lever with said extension to inhibit rotational movement of said lever about said another point.

18. The method of claim 17, further comprising a step of bending said lever at a grip end to make a handle.

19. The method of claim 18, further comprising drilling a hole in said reel and lever, providing a fastener that is sized to fit into said hole, and attaching said lever by inserting said fastener through said lever and hole.

20. A swimming pool cover system comprising:

a drum positioned at one end of a swimming pool;

a cover movable between a closed position in which said cover is positioned over said swimming pool and an open position in which said cover is displaced from said closed position, said cover having a drum edge attached to said drum and a leading edge opposite to said drum edge, and said cover having a first side edge positioned opposite to a second side edge;

first rope means attached proximate to said leading edge and said first side edge, said first rope means extending from said leading edge for urging said cover toward said closed position;

second rope means attached proximate to said leading edge and said second side edge, said second rope means extending from said leading edge for urging said cover toward said closed position;

a drive shaft connected to said drum;

first reel means positioned on said drive shaft and mounted to be driven thereby to receive said first rope means and to thereby urge said cover toward said closed position and to supply said first rope means as said cover moves from said closed position toward said open position;

second reel means positioned on said drive shaft and mounted to be driven thereby to retrieve said second rope means and to thereby urge said cover toward said closed position and to supply said second rope means as said cover moves from said closed position toward said open position;

a reel locking system including:

a ratchet drum with cogs positioned to be driven by said drive shaft, said ratchet drum being positioned adjacent to said first and second reel means, a first pawl assembly attached to said first reel means, said first pawl assembly including a first pawl arranged to move between a first pawl position in which said first pawl drivingly engages at a first contact point of said first pawl a cog of said ratchet drum upon rotation of said ratchet drum in a first direction and a second pawl position in which said first pawl ratchets over said cogs upon rotation of said ratchet drum in a second direction, wherein said first pawl further includes a first extension extending from a first surface away from said first contact point, a second pawl assembly attached to said second reel means, said second pawl assembly including a second pawl arranged to move between a third pawl position in which said second pawl drivingly engages a cog of said ratchet drum upon rotation of said ratchet drum in said first direction and a fourth pawl position in which said second pawl ratchets over said cogs upon rotation of said ratchet drum in said second direction, a first lever pivotally attached to said first reel means, said first lever being movable between a first lever position in which said first lever engages and retains said first pawl in said first pawl position by engaging with at least said first surface to inhibit rotational movement of said first pawl away from said ratchet drum, and wherein said first extension being used for inhibiting rotational movement of said first lever when in said first pawl position, and a second lever position in which said first lever is disengaged from said first pawl, and a second lever pivotally attached to said second reel means, said second lever being movable between a third lever position in which said second lever engages and retains said second pawl in said third pawl position and a fourth lever position in which said second lever is disengaged from said first pawl; and motor means connected to said drive shaft to rotate said drum and to, in turn, urge said cover toward said open position and to said ratchet drum to urge rotation of said first reel means and said second reel means to, in turn, tension said first rope means and said second rope means to thereby urge said cover toward said closed position.

* * * * *